United States Patent [19]

Bruinette

[11] 3,973,297

[45] Aug. 10, 1976

[54] CABLE ANCHORING EQUIPMENT

[75] Inventor: Konstant E. Bruinette, Johannesburg, South Africa

[73] Assignee: Triple Bee & Prestress (Proprietary) Limited, Pretoria, South Africa

[22] Filed: Sept. 30, 1974

[21] Appl. No.: 510,649

[30] Foreign Application Priority Data

Dec. 14, 1973 South Africa ..... 73/9481

[52] U.S. Cl. ..... 24/122.6; 24/136 B; 52/223 L; 403/374

[51] Int. Cl.[2] ..... F16G 11/04

[58] Field of Search ..... 24/115 M, 122.6, 136 L, 24/136 B, 136 R; 52/223 L, 230, 227; 403/369, 374

[56] References Cited

UNITED STATES PATENTS

| | | | |
|---|---|---|---|
| 2,609,586 | 9/1952 | Parry | 24/122.6 X |
| 2,611,262 | 9/1952 | Dodson et al. | 52/227 |
| 2,827,679 | 3/1958 | Blaton | 24/115 M |
| 3,099,109 | 7/1963 | Hahn | 24/122.6 X |
| 3,596,330 | 8/1971 | Scott et al. | 52/233 L X |
| 3,605,361 | 9/1971 | Howlett et al. | 24/122.6 X |
| 3,701,509 | 10/1972 | Stinton | 52/223 L X |
| 3,757,390 | 9/1973 | Edwards | 52/233 L X |
| 3,778,869 | 12/1973 | Andrews | 24/122.6 X |
| 3,790,657 | 2/1974 | Leonte | 52/227 |
| 3,819,287 | 6/1974 | Axelsson et al. | 24/136 R X |

FOREIGN PATENTS OR APPLICATIONS

| | | | |
|---|---|---|---|
| 713,750 | 7/1965 | Canada | 24/126 |
| 1,369,566 | 7/1964 | France | 403/369 |
| 45,010 | 5/1926 | Norway | 24/136 R |
| 1,117,114 | 6/1968 | United Kingdom | 52/230 |

*Primary Examiner*—Roy D. Frazier
*Assistant Examiner*—Rodney H. Bonck
*Attorney, Agent, or Firm*—Cushman, Darby & Cushman

[57] ABSTRACT

The invention is concerned with cable couplers which enable cables used in the stressing of contiguous concrete construction units to be joined together with the ends of the units close together. The coupler consists of a housing having at least one blind passage therein of generally rectangular cross-section and with one pair of walls oppositely divergent towards the blind end of the passage which houses a wedge assembly cooperating with the divergent walls and adapted to secure at least one cable end in the housing. The invention also provides for the housing to have a further passage therethrough with a pair of walls oppositely inclined to those of the first mentioned passage so that a cable may be similarly secured in the housing from the opposite direction.

5 Claims, 8 Drawing Figures

Fig 1.
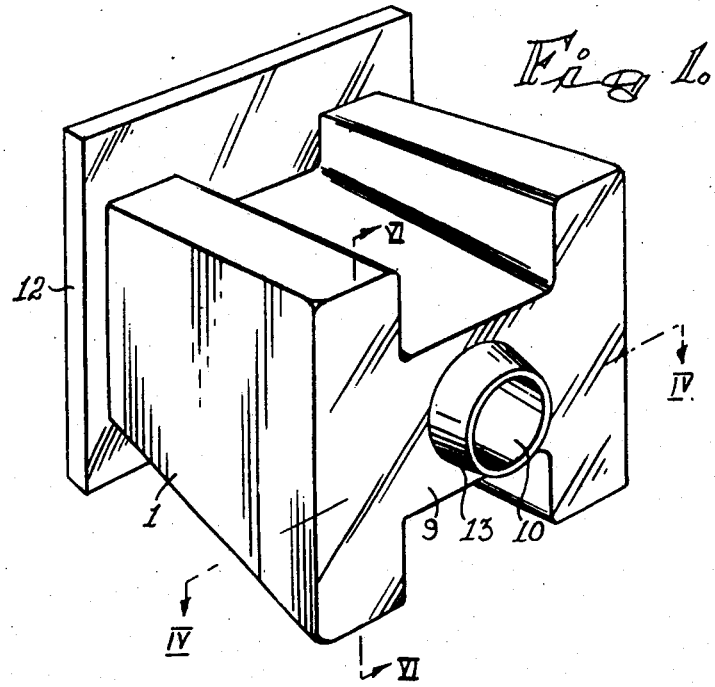
Fig 2.
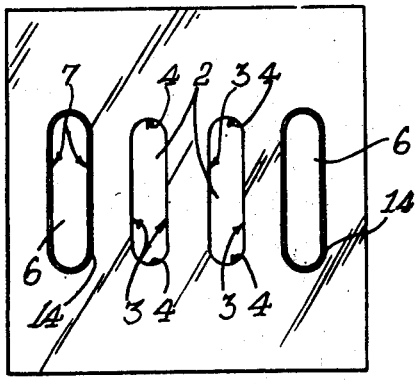
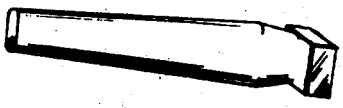
Fig 3.
Fig 4.
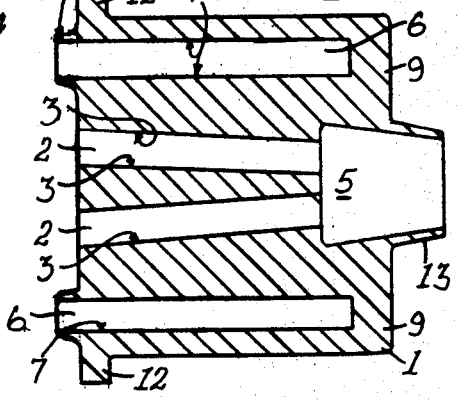

CABLE ANCHORING EQUIPMENT

This invention relates to cable anchors and more particularly to cable anchors of the type generally used with prestressed concrete structures to secure the ends of tensioned cables, rods, strands and the like, hereinafter commonly referred to as cables.

Cable anchors and couplings are often used together and particularly where prestressed structures such as beams for example are located in series. In such a case the cables projecting outwardly from a cable anchor at the end of a beam are cut off close to the wedges to facilitate working. Subsequently the cable ends of an adjacent beam are connected to the cut-off ends by means of a coupling. It is also often desirable to enable the outwardly projecting ends of cables from contiguous beams to be coupled with the beam ends as close to each other as possible.

It is the object of this invention to provide a coupler which will enable projecting ends of cables from one beam to be coupled into the end of contiguous beam.

A further object of this invention is to provide a cable anchor which combines the effects of a cable anchor and a cable coupling.

According to this invention there is provided a cable coupler comprising a housing, a blind passage in the housing, at least one pair of oppositely disposed walls of the passage divergent towards the blind end and a wedge assembly within the passage adapted to cooperate with said divergent walls to secure the end of at least one cable end in the housing.

Further features of this invention provide for the passages and wedges to be of substantially rectangular cross-section, for there to be a plurality of blind passages and wedge assemblies in the housing, for the housing to include one or more further passages extending through the housing convergent towards the blind end of the other passages and including wedge assemblies adapted to anchor at least one cable in each such passage and for these other passages to converge into a single opening from the housing at their narrow ends.

The invention also provides for the housing to be peripherally flanged at the open end of the blind passage or passages and for these passages to be inclined to the axis of the housing.

Still further features of the invention provide for the wedge assemblies to be three wedges, the middle wedge being adapted to be inserted in the passage between the other two wedges which are adapted to retain a cable against the wall of the passage, or to be a pair of wedges biased towards the narrow end of the passage and having cable receiving recesses formed in their opposed faces.

Preferred embodiments of the invention will be described below by way of example only reference being made to the accompanying drawings in which:

FIG. 1 is a rear isometric view of a cable anchor in accordance with the invention;

FIG. 2 is a front end elevation of the cable anchor in FIG. 1;

FIG. 3 is an isometric view of a middle wedge;

FIGS. 4 and 5 are cross-sectional side elevations of the cable anchor;

Figure 5:
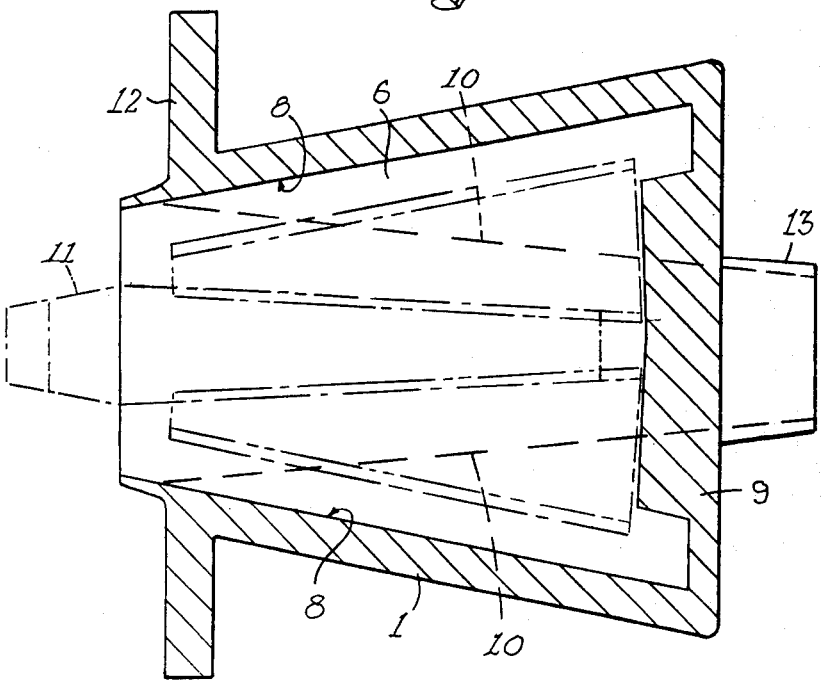

In the embodiment of the invention (shown in FIGS. 1 to 5) a cable anchor is designed to engage a set of four cables and simultaneously to have the characteristics of a cable coupling.

The cable anchor shown in FIG. 1 comprises a housing 1 arranged to receive a set of wedges therein, the wedges being preferably of the type having a substantially rectangular cross-section and with concave formations provided along the narrow convergent edges thereof.

The housing 1 can be inexpensively made by a casting operation and has two passages 2 through the central region of the housing. Preferably the material used will be spheroidal graphite. Each of these two central passages is basically rectangular in cross-section with two opposite surfaces 3 substantially parallel whereas the other two opposite surfaces 4 converge toward one end of the housing. The two central passages 2 also converge towards each other so as to meet at the smaller end of the passages as shown in FIG. 4. These passages are symmetrically arranged so as to afford a minimum moment of force on the housing when cables are secured therein.

Each of the two central passages 2 is adapted to receive a wedge therein conforming substantially to a passage. The wedge has two flat opposite sides and two inclined sides, the latter being preferably concave to conform with the surface of a cable. Similarly the convergent opposite sides 4 of the central passages 2 are also preferably made concave to conform with a cable.

The housing 1 is provided with a further two passages 6 substantially parallel to each other and to the central passages and on each side of the latter. The passages are also basically rectangular in cross-section with two opposite sides 7 parallel and the other two sides 8 being concave to conform with the surface of a cable. However, these outer passages have bigger parallel sides than the central passages as shown in FIG. 5 and converge in the opposite direction to the central passages. Furthermore the larger end 9 of the passages 6 are closed.

Unlike the central passages, the outer passages 6 are each adapted to receive therein a set of three wedges as shown in FIG. 5. While the two side wedges 10 are conveniently of the type used in the central passages, the central wedges 11 as shown in FIG. 3 is longer and serves to urge the side wedges 10 towards the convergent sides 8 of the passage.

The housing 1 has a square flange 12 made integral therewith and said flange 12 is preferably located at the end of the housing with all the passages open. It will be appreciated that the wedges can only be inserted from this end being the bigger end of the central passage and the smaller open end of the outer passages.

The cable anchor is used in the usual manner by clamping the flange 12 to shuttering with the anchor flange flush with the shuttering and the other end projecting into the concrete. Projective cable sheaths are connected to the housing by means of lips 13, 14 projecting from the ends of the passages. As shown, a single annular lip 13 projects adjacent the smaller end 5 of the central passages so that only one sheath is necessary for the two passages. Each outer passage instead is provided with its own lip 14 at the smaller end thereof.

Concrete is cast in the shuttering and when set the shuttering may be removed. Four cables passed through the sheaths and the central passages in the housing may be tensioned and locked by inserting the respective wedges in the central passages.

The ends of four other cables may be wedged in the peripheral passages by first inserting the two side wedges 10 in each passage, locating the ends of cables against the convergent sides 8 of the passage and finally inserting the central wedge 11 to urge the side wedges 10 laterally against the cables.

It will be appreciated that such a cable anchor functions both as a conventional cable anchor and a cable coupling simultaneously. Further the cable anchor can be used as a plain conventional cable anchor by using only the central passages, alternatively it can be used as a cable coupling.

Figure 6:
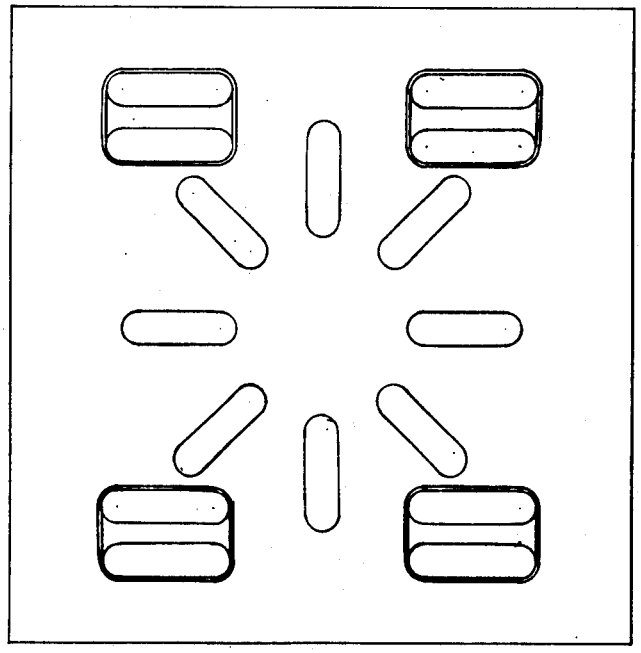
FIG. 6 is a front end elevation of an alternate form of the cable anchor.

FIG. 6 shows a cable anchor for 16 cables which are to be wedged in the central passages. Another 16 cable ends may then be coupled to the outer passages. Cable anchors for any described number of cables can be made on the same principle. Anchors for 4, 8, 12, 16 and 20 cables are found particularly useful in practice.

Figure 7:
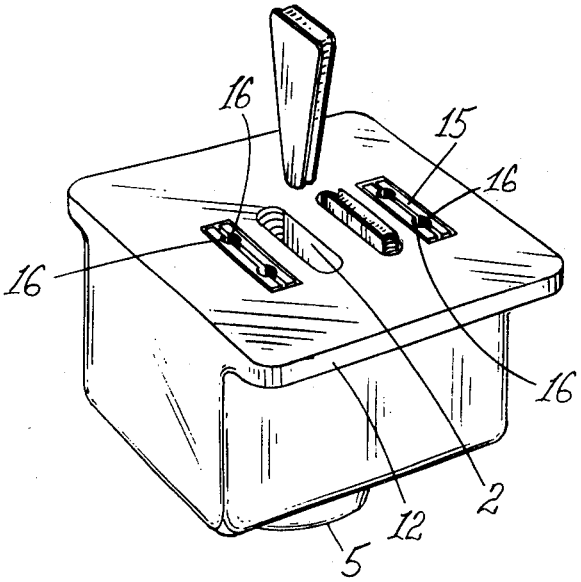
FIGS. 7 and 8 illustrate a different wedge assembly.
Figure 8:
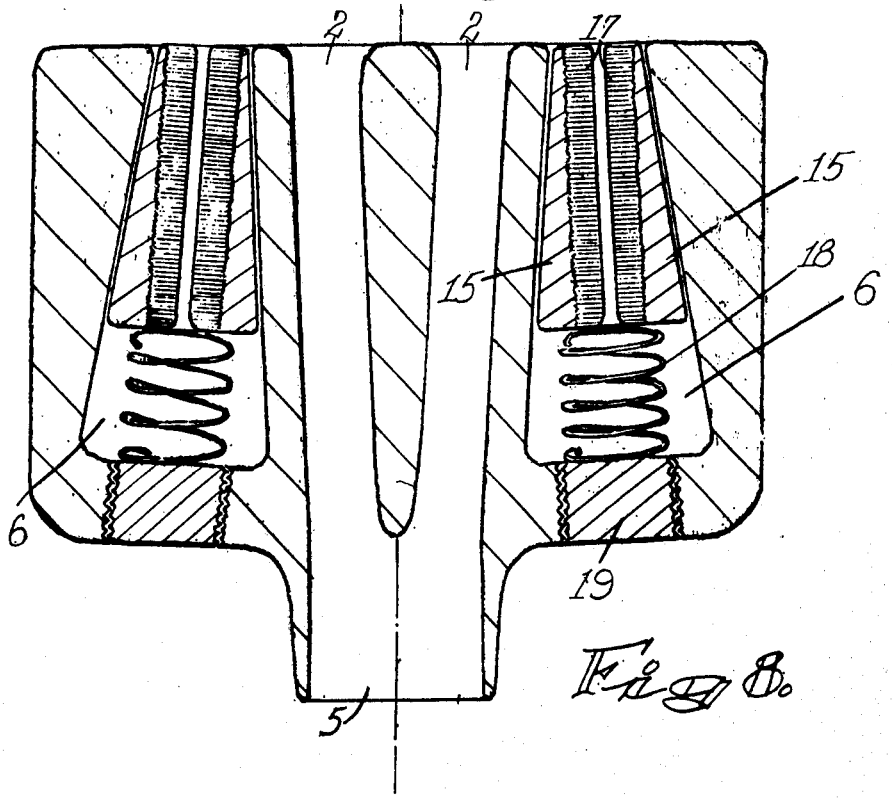

The embodiment in FIGS. 7 and 8 show an alternative wedge assembly for the blind outer passages 6. In this form only two wedges 15 are used in each passage 6 but these have recesses 16 formed in oppositely facing surfaces 17 of the wedge 15. The cables are thus adapted to be clamped between the wedges themselves and not between the edge of the wedges and the wall of the passages in the housing.

This construction requires that the wedges 15 be biased to be located towards the narrower end of their respective passages and this can conveniently be effected by introducing compression springs 18 through openings subsequently plugged by plugs 19 in the blind end of the passages 6.

In this form of the invention the ends of cables to be coupled are inserted between appropriate recessed 16 by forcing the wedges 15 against the springs 18. When this force is released the wedges will prevent withdrawal of the cables by their normal reaction with the housing 1.

In the form of the invention shown in FIGS. 3 and 5 and in the form thereof shown in FIG. 8, respectively, the wedge part 11 and the springs 18 provide means for applying a positive initial engagement force to each secured cable to retain the wedge assembly in the blind passage.

By using only one unit for both a cable anchor and coupling, the installation of prestressed structures will be less expensive and easier. Further, since the whole anchor is embedded in the concrete and, since there is not cable coupling spaced therefrom, the spacing between adjacent cables and the size of for example post-tensioned concrete beams can be diminished.

It is considered that the cable anchor and particularly the anchoring system employing more than one wedge is not confined in application to cable anchors for use with prestressed concrete structures but may have other applications.

What we claim as new and desire to secure by Letters Patent is:

1. A cable coupler, comprising:

a housing;

means defining at least one blind passage of generally rectangular transverse cross-section opening through only one end of the housing, and including two generally parallel opposed walls and two opposed walls which diverge as the passage proceeds towards its blind end; and a multiple-part wedge assembly received within the passage and including on at least one said part thereof at least one concave cross-sectioned surface portion, each for securing a single cable between itself and a respective one of said two opposed walls which diverge, the wedge assembly including means for applying a positive initial engagement force to each secured cable and for cooperating with said two opposed walls which diverge to retain the wedge assembly in the blind passage;

a plurality of further passages in the housing having their axes mutually inclined toward one another;

said plurality of further passages joining in a single outlet at the opposite end of the housing from the one through which said at least one blind passage opens; and a lip projecting axially outwards from the housing peripherally of said single outlet, for receiving a cable sheath.

2. A cable coupler as claimed in claim 1 in which the multiple-part wedge assembly includes three wedges, two wedges having their wider ends associated with the blind end of the passage and each adapted to engage a cable against the associated divergent wall of the passage, and the third wedge oppositely directed and located between the other wedges.

3. A cable coupler, comprising:

a housing;

means defining at least one blind passage of generally rectangular transverse cross-section opening through only one end of the housing, and including two generally parallel opposed walls and two opposed walls which diverge as the passage proceeds towards its blind end; and a multiple-part wedge assembly received within the passage and including on at least one said part thereof at least one concave cross-sectioned surface portion, each for securing a single cable between itself and a respective one of said two opposed walls which diverge, the wedge assembly including means for applying a positive initial engagement force to each secured cable and for cooperating with said two opposed walls which diverge to retain the wedge assembly in the blind passage;

at least one further passage proceeding through the housing, said further passage including a pair of opposed walls which diverge in the opposite longitudinal sense from that of the diverging two opposed walls of said blind passage;

another wedge assembly having surface means thereon for engaging a cable, when received in the further passage, between one of the diverging two opposed walls of the further passage and said other wedge assembly;

said at least one blind passage and said at least one further passage each being provided in multiplicity;

said multiple-part wedge assembly and said other wedge assembly being provided in a respective multiplicity, one for each respective passage;

the further passages of the plurality of further passages each having its longitudinal axis inclined toward the others;

said plurality of further passages joining in a single outlet at the opposite end of the housing from the one through which the plurality of blind passages open.

4. The cable coupler of claim 3, wherein the passages are symmetrically arranged on the housing, thereby affording a minimum moment of force on the housing when cables are secured therein.

5. The cable coupler of claim 3, further including:

a lip projecting axially outwards from the housing peripherally of said single outlet, for receiving a cable sheath; and a peripheral clamping flange radiating from the end of the housing through which the blind passages open.

* * * * *